US006023999A

United States Patent [19]

Cho

[11] Patent Number: 6,023,999

[45] Date of Patent: Feb. 15, 2000

[54] UNIVERSAL SOCKET FOR USE WITH A SOCKET WRENCH

[76] Inventor: Jin-Chai Cho, 2F, No. 26, Lane 43, Pa Te Road, Sec. 1, Taipei, Taiwan

[21] Appl. No.: 09/165,803

[22] Filed: Oct. 2, 1998

[51] Int. Cl.[7] ..... B25B 13/58

[52] U.S. Cl. ..... 81/185; 81/DIG. 11

[58] Field of Search ..... 81/185, 124.5, 81/DIG. 11, 124.4, 461, 442, 179

[56] References Cited

U.S. PATENT DOCUMENTS 3,698,267 10/1972 Denney ..... 81/185
5,193,420 3/1993 Smith ..... 81/185 X
5,791,209 8/1998 Marks ..... 81/185
5,806,385 9/1998 Schupp ..... 81/185
5,829,328 11/1998 Chen ..... 81/185

*Primary Examiner*—D. S. Meislin
*Attorney, Agent, or Firm*—Bacon & Thomas

[57] ABSTRACT

A universal socket used with a wrench for turning different sizes of bolts, nuts, etc., the universal socket including a socket body having a working hole at one end for receiving the workpiece, a nest block mounted in the working hole of the socket body to hold a set of retaining pins in vertical through holes thereof, and spring elements respectively mounted in the nest block to push the retaining pins out of the nest block for holding down the workpiece, permitting the workpiece to be turned with the socket body when the socket body is turned with the wrench by hand.

2 Claims, 2 Drawing Sheets

UNIVERSAL SOCKET FOR USE WITH A SOCKET WRENCH

BACKGROUND OF THE INVENTION

The present invention relates to a socket for use with a socket wrench to turn bolts, nuts, etc., and more particularly to a universal socket which has spring-supported vertically slidable retaining pins in the socket body thereof for holding down any of different sizes of bolts, nuts, etc., so that different sizes of bolts, nuts, etc. can be turned with the socket by a wrench.

Regular sockets for use with a socket wrench are designed to turn a particular size of bolts, nuts, etc., i.e., one socket fits only one particular size of workpiece. There is known a universal socket that can be used with a socket wrench to turn different sizes of bolts, nuts, etc. This structure of universal socket comprises a socket body having a working hole at one end for receiving the workpiece to be turned, a plurality of spring elements fixedly mounted in the working hole of the socket body, and a plurality of retaining blocks respectively supported on the spring elements and arranged in parallel within the socket body for holding down the workpiece to be turned, for permitting the workpiece to be turned with the socket body by a socket wrench. This structure of universal socket is not satisfactory in function. Because no guide means is provided to guide axial movement of the retaining blocks and the spring elements, the spring elements tend to be tangled with one another.

SUMMARY OF THE INVENTION

The present invention has been accomplished to provide a universal socket which eliminates the aforesaid problem. According to one aspect of the present invention, the universal socket comprises a socket body having a working hole at one end for receiving the workpiece, a nest block mounted in the working hole of the socket body to hold a set of retaining pins in vertical through holes thereof, and spring elements respectively mounted in the nest block to push the retaining pins out of the nest block for holding down the workpiece, permitting the workpiece to be turned with the socket body when the socket body is turned with the wrench by hand. According to another aspect of the present invention, the retaining pins each have a flanged rear end respectively moved with the retaining pins in the vertical through holes of the nest block, and the vertical through holes of the nest block each have a flanged mouth at the bottom for stopping the flanged rear ends of the respective retaining pins in the respective vertical through holes.

DETAILED DESCRIPTION OF THE PREFERRED EMBODIMENT

Figure 1:
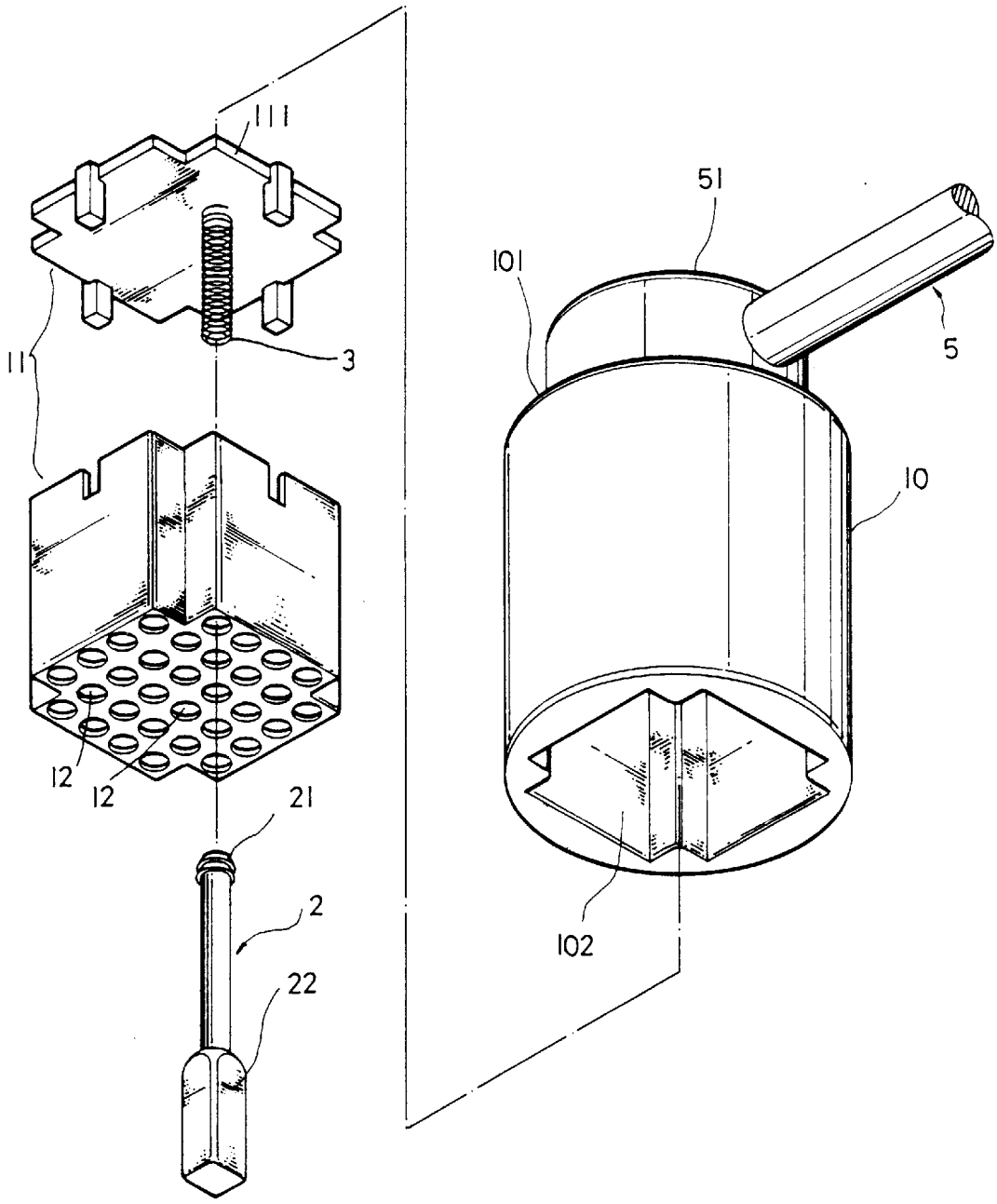
FIG. 1 is an exploded view of a universal socket according to the present invention.
Figure 2:
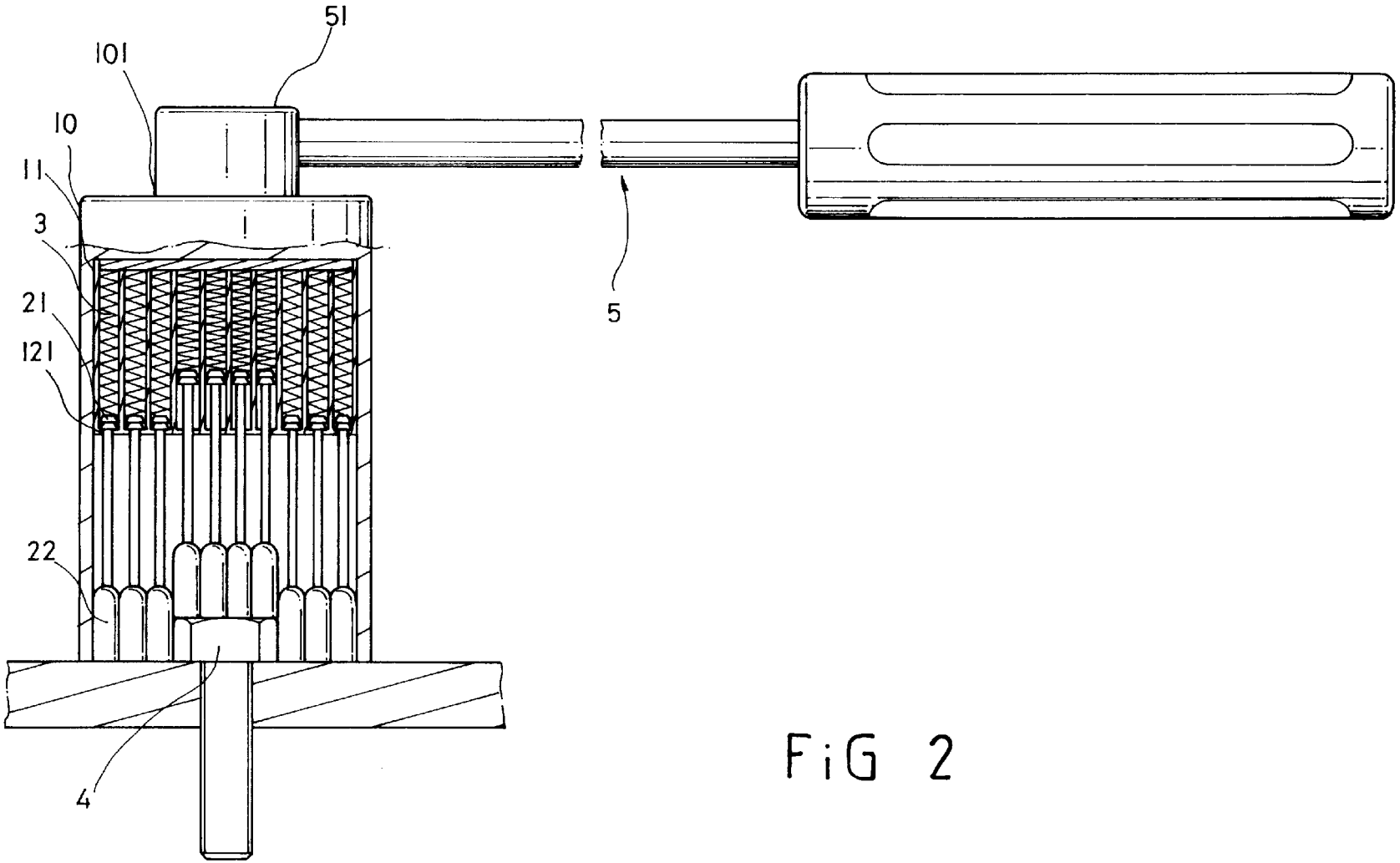
FIG. 2 is an applied view in section of the present invention, showing the universal socket coupled to a wrench and attached to a nut.

Referring to FIGS. 1 and 2, a universal socket in accordance with the present invention comprises a socket body 10. The socket body 10 has a coupling hole 101 at its top end, and a working hole 102 at bottom end. A nest block 11 is mounted in the working hole 102 of the socket body 10. The nest block 11 has an array of vertical through holes 12 through top and bottom sides thereof, and a cover plate 111 covered on its top side. When the nest block 11 is installed in the working hole 102 of the socket body 10, the cover plate 111 of the nest block 11 is disposed adjacent to the coupling hole 101. The vertical through holes 12 each have a flanged mouth 121 at the bottom end (the bottom side of the nest block 11). A plurality of retaining pins 2 are slidably mounted in the vertical through holes 12 of the nest block 11. The retaining pins 2 each have a flanged rear end 21 moved with the respective retaining pins 2 in the vertical through holes 12 and stopped inside the respective vertical through holes 12 by the flanged mouth 121, and an expanded front end 22 disposed outside the nest block 11 within the socket body 10. The flanged rear end 21 of each retaining pin 2 is a tapered flange. Further, a plurality of spring elements 3 are respectively mounted in the vertical through holes 12 inside the nest block 11, and stopped between the cover plate 111 and the flanged rear ends 21 of the retaining pins 2. The spring elements 3 impart a downward pressure to the respective retaining pins 2, causing the flanged rear ends 21 of the retaining pins 2 to be respectively stopped at the flanged mouths 121 of the vertical through holes 12.

Referring to FIG. 2 again, when in use, the universal socket is attached to the workpiece for example a nut 4, permitting the retaining pins 2 at the center area to be pushed inwards by the nut 4 against the respective spring elements 3 and the retaining pins 2 at the border area to be retained in contact with the periphery of the nut 4, then the coupling head 51 of a wrench 5 is coupled to the coupling hole 101 of the socket body 10 and turned with the hand to rotate the socket body 10, causing the nut 4 to be fastened tight or loosened. When the universal socket is removed from the nut 4, the retaining pins 2 at the center area are pushed outwards, causing the expanded front ends 22 of the retaining pins 2 to be maintained at the same elevation (in flush with the bottom side edge of the socket body 10).

While only one embodiment of the present invention has been shown and described, it will be understood that various modifications and changes could be made thereunto without departing from the spirit and scope of the invention disclosed.

What the invention claimed is:

1. A universal socket comprising:

a socket body, said socket body comprising a coupling hole at a top end thereof adapted to receive a coupling head of a wrench, and a working hole at a bottom end thereof adapted to receive a workpiece, for permitting the workpiece to be turned with said socket body by the wrench;

a nest block mounted in the working hole of said socket body, said nest block comprising an array of vertical through holes through top and bottom sides thereof, and a cover plate covered on the top side and disposed adjacent to the coupling hole of said socket body, said vertical through holes each having a flanged mouth at the bottom side of said nest block;

a plurality of retaining pins respectively slidably mounted in the vertical through holes of said nest block, said retaining pins each having a flanged rear end moved with the respective retaining pins in the vertical through holes of said nest block and stopped inside the vertical through holes of said nest block by the flanged mouths of said vertical through holes, and an expanded front end disposed outside said nest block within said socket body; and a plurality of spring elements respectively mounted in said vertical through holes inside said nest block, and stopped between the cover plate of said nest block and the flanged rear ends of said retaining pins to push said retaining pins out of said nest block.

2. The universal socket of claim 1 wherein the flanged rear end of each of said retaining pins is a tapered flange.

* * * * *